United States Patent [19]

Knabel et al.

[11] 4,451,059

[45] May 29, 1984

[54] HEELHOLDER FOR SAFETY SKI BINDINGS

[75] Inventors: Walter Knabel, Murnau; Ludwig Wagner, Farchant; Roland Jungkind, Garmisch-Partenkirchen, all of Fed. Rep. of Germany

[73] Assignee: MARKER-Patentverwertungsgesellschaft mbH, Baar, Switzerland

[21] Appl. No.: 347,193

[22] Filed: Feb. 9, 1982

[30] Foreign Application Priority Data

Feb. 13, 1981 [DE] Fed. Rep. of Germany ..... 3105294

[51] Int. Cl.[3] ..... A63C 9/08

[52] U.S. Cl. ..... 280/632

[58] Field of Search ..... 280/626, 631, 632, 623

[56] References Cited

U.S. PATENT DOCUMENTS

| | | | |
|---|---|---|---|
| 3,408,087 | 10/1968 | Ramillon | 280/631 |
| 3,620,544 | 11/1971 | Shinohara | 280/631 |
| 3,620,545 | 11/1971 | Korger et al. | 280/632 |
| 3,820,804 | 6/1974 | Benner | 280/632 |

FOREIGN PATENT DOCUMENTS

| | | | |
|---|---|---|---|
| 2163022 | 6/1973 | Fed. Rep. of Germany | 280/632 |
| 2659383 | 4/1978 | Fed. Rep. of Germany | 280/631 |
| 2101623 | 7/1980 | Fed. Rep. of Germany | 280/626 |

*Primary Examiner*—Joseph F. Peters, Jr.
*Assistant Examiner*—Michael Mar
*Attorney, Agent, or Firm*—D. Peter Hochberg

[57] ABSTRACT

A heelholder for a safety ski binding comprising a carriage, a soleholder pivotally mounted on the carriage and carrying a lever, a first locking lever mounted on the carriage and disposed in the path of the soleholder lever and biassed towards a blocking position by a release controlling spring so that the soleholder normally cannot be opened unless the force of the spring is overcome, a second locking lever for releasably blocking the soleholder lever from movement from a position obstructed by the first locking member, and a toggle joint for voluntarily moving the second locking lever to unblock the soleholder lever to enable release of the binding with a small force.

6 Claims, 2 Drawing Figures

HEELHOLDER FOR SAFETY SKI BINDINGS

This invention relates to a heelholder for safety ski bindings, which heelholder comprises a soleholder, which is pivoted on a transverse horizontal axis and biased by an opening spring and provided with a closing pedal, a first locking member, which is pivoted on an axis that is parallel to the pivotal axis of the soleholder or which is slidable in the longitudinal direction of the ski and biased by a release-controlling spring and when the heelholder is in its operative position engages from behind a member which is movably mounted in the soleholder and which when the heelholder is in its operative position is locked by a second locking bar, which is pivotally movable with the soleholder, and a manually operable mechanism for moving the second locking member against the force of a retaining spring to an unlocking position so as to arbitrarily open the heelholder.

Various designs for such heelholders are known or have been disclosed. Various designs permit an automatic opening of the heelholder also when the skiing boot has been released in response to a twisting fall by a mechanism provided at the toe iron of the safety ski binding.

Those heelholders of the above-mentioned kind which are commercially available or described in the literature have the disadvantage that when they are small a relatively strong force is required to arbitrarily open the heelholder or that when they are too bulky they can be arbitrarily opened by a relatively small force.

For this reason it is an object of the present invention so to improve and design a heelholder of a safety ski binding of the above-mentioned kind that it is compact and yet can easily be opened arbitrarily.

This is accomplished according to the invention in that the manually operable mechanism consists of a toggle joint, which is connected between the soleholder and the second locking member. Such toggle joint can provide for a large mechanical advantage without need for very long arms.

A simple actuation will be permitted if one arm of the toggle joint has a portion which extends beyond the hinge of the joint and which is formed with a depression. In this way, e.g., a slipping of a finger of a glove-covered hand or a point of a ski pole from the toggle joint can be effectively prevented.

According to a further feature of the invention, the shoe-receiving part of the soleholder and the hinge of the toggle joint are disposed on opposite sides of the pivotal axis of the soleholder. In that case, pressure applied to the toggle joint will tend to move the soleholder in an opening sense.

Further features of the heelholder according to the invention are apparent from the dependent claims.

Figure 1:
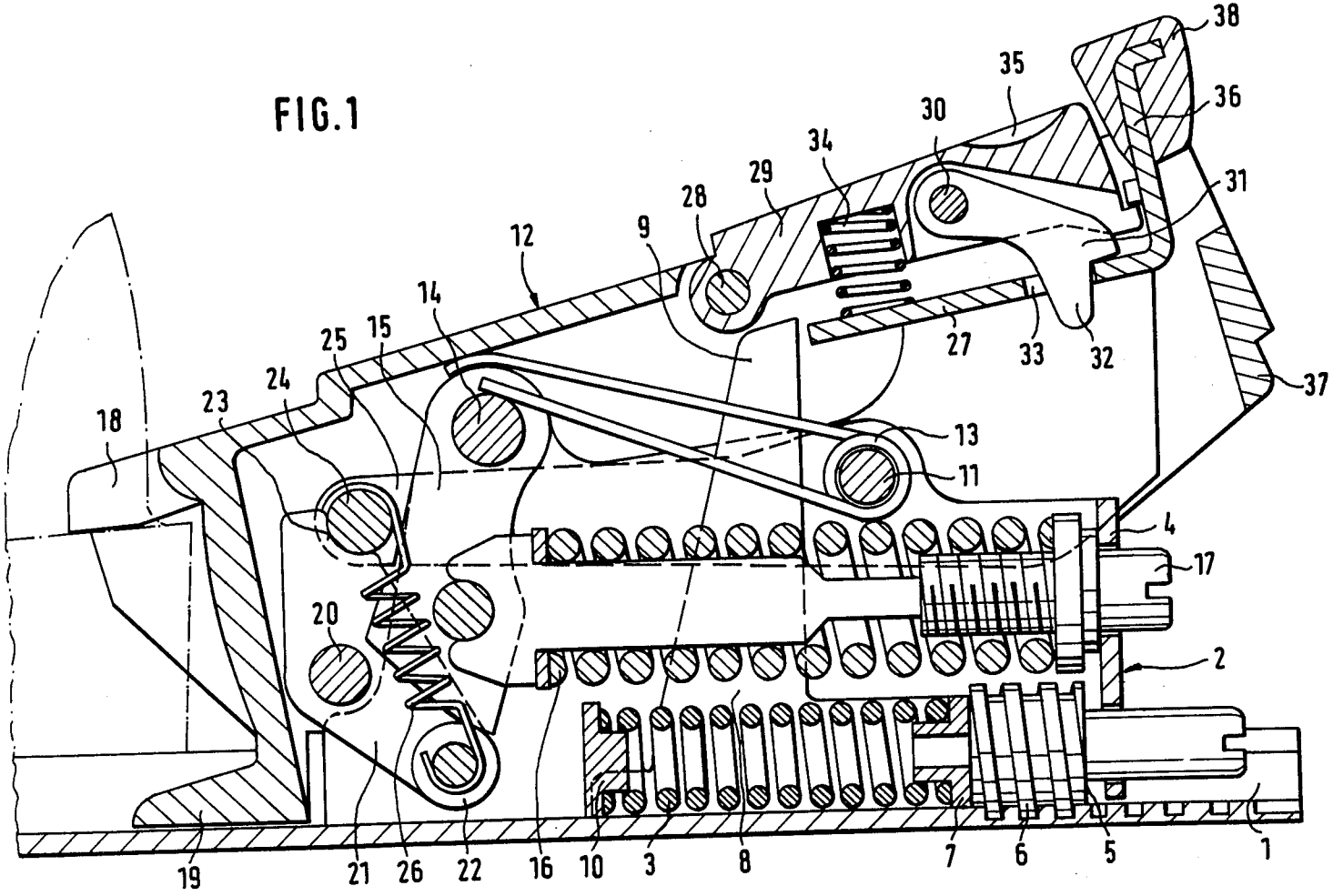
Figure 2:
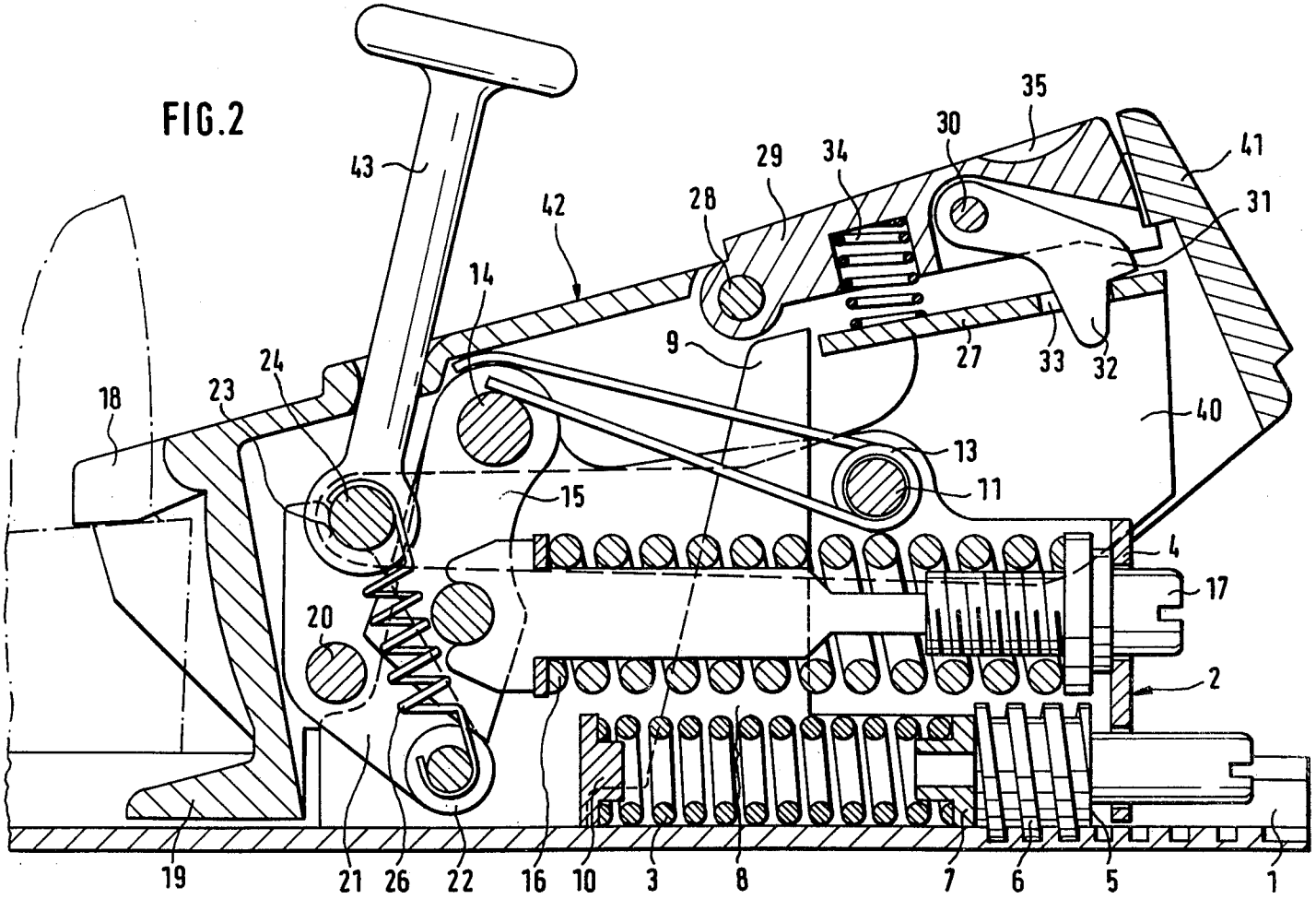

Two illustrative embodiments of the invention will be described more fully hereinafter with reference to the accompanying drawings, in which FIG. 1 is a central longitudinal sectional view showing a first embodiment of the heelholder in operative position, with the skiing boot inserted and FIG. 2 is a view that is similar to FIG. 1 and shows a second embodiment of the heelholder.

The heelholder shown in FIG. 1 has a baseplate 1, which is adapted to be secured in the conventional manner to the top of a ski. A carriage 2 is mounted on the baseplate and slidable thereon in the longitudinal direction of the ski. The carriage 2 is biased by a contact pressure spring 3, which holds the carriage 2 in its forward end position when no skiing boot is held in the binding. That end position is defined by the engagement of the rear end wall 4 of the carriage 2 with a collar 5 carried by an adjusting screw 6. The screw threads of the screw interengage with mating screw threads in the baseplate 1. The contact pressure spring 3 bears on the adjusting screw 5 with a spring abutment 7 interposed, which constitutes part of a member 8. A vertical leg 9 of the member 8 has a free end, which constitutes a stop. The latter will be described more fully hereinafter. Adjacent to the carriage 2, the contact pressure spring 3 bears on an abutment 10.

A pivot pin 11 is secured in the side walls of the carriage 2. A soleholder designated 12 is mounted on the pivot pin 11 and is biased by an opening spring 13, which consists of a spiral spring that is subjected to bending and tends to move the soleholder to its open position. The opening spring is mounted on the pivot 11 and adjacent to the carriage bears on a transverse pivot pin 14, which is mounted in the side walls of the carriage 2 and parallel to the pivot pin 11. A first locking lever 15 is mounted on the pivot pin 14 and is biased by a release-controlling spring 16, which bears on the rear end wall 4 of the carriage with an adjusting screw 17 interposed.

The soleholder 12 comprises a conventional holding-down portion 18 and a spurlike pedal 19. A lever 21 is mounted on a horizontal transverse pivot pin 20 for a limited pivotal movement. That lever 21 is two-armed and at its forward end carries a detent roller 22, which is intended to cooperate with the first locking lever 15. The upper end portion of the lever 21 is formed with a depression 23 for receiving a locking pin 24. That locking pin is seen at the left-hand end of a second locking lever 25, which is mounted on the pivot pin 11. A retaining spring 26 consisting of a tension spring is connected between the locking pin and the axle of the detent roller 22 and normally holds the locking pin 24 in the depression 23 of the lever 21. The second locking lever 25 consists of a bent sheet metal stamping having two congruent legs and a web 27 connecting said legs. The web 27 and the locking pin 24 are disposed on opposite sides of the pivot pin 11.

A pivot pin 28 extending parallel to the pivot pin 20 is mounted in the soleholder 12. A toggle joint comprises an arm 29, which is mounted on the pivot pin 28, and a second arm 31, which is connected to the first arm 29 by a hinge 30 and is provided at its free end with an offset nose 32, which extends into an opening 33 in the web 27 of the second locking lever 25. A weak helical compression spring 34 bears on the web 27 and tends to collapse the toggle joint. The arm 29 of the toggle joint has an extension beyond the hinge 30. That extension is formed with a depression 35, the purpose of which will be described hereinafter.

On that side which is opposite to the legs of the second locking lever 25, the web 27 of said lever 25 carries a lug 36, which is angled from the web 27 and extends at right angles to said legs behind the toggle joint. The lug 36 carries at its free end a cap 38, which can be used as a pedal in a manner which will be described hereinafter. A rear end wall 37 of the soleholder 12 constitutes a stop for cooperating with the cap 38 so as to limit the pivotal movement of the second locking lever 25 in the soleholder 12.

FIG. 1 shows the heelholder in operative position. The skiing boot held by the binding is indicated in phantom. If the holding-down portion 18 of the soleholder 12 is acted upon by an upwardly directed force which exceeds the opposing force exerted by the release-controlling spring 16, a safety opening function of the heelholder will be initiated in the conventional manner in that the detent roller 22 turns back the first locking lever 15 so that the soleholder 12 turns about the pivot 11 in the clockwise sense in the drawing.

For an arbitrary opening of the heelholder, the arm 29 of the toggle joint can be depressed. For this purpose a finger tip or the point of a ski pole can be used to apply pressure to the arm 29 at the depression 35. As a result, the toggle joint is extended so that the second locking lever 25 is turned about the pivot pin 11, so that the locking pin 24 disengages the depression 23 of the lever 21 and when the soleholder 12 is turned in the clockwise sense the detent roller 22 carried by the lever 21 can roll around the first locking lever 15, which is held in its forward end position. When the skiing boot has separated from the heelholder, the opening spring 13 moves the soleholder 12 to its open position, in which the heelholder is ready to receive the skiing boot. When the toggle joint has been released, it is returned by the helical compression spring 34 to its initial position. The resetting spring 26 moves the second locking lever 25 so that its locking spring 24 re-engages the lever 21 in the depression 23.

The lug 36 of the second locking lever 25 extends past the outer end of the toggle joint and serves to prevent an unintended actuation of the toggle joint. This is important because the toggle joint of the heelholder according to the invention can be actuated by small forces. As has been mentioned hereinbefore, the cap 38 carried by the lug 36 serves as a pedal. The cap 38 can be depressed by a sufficiently large force exerted, e.g., by means of a skiing boot or a ski, so that the second locking lever 25 is turned to move its locking pin 24 out of the depression 23. The heelholder can be arbitrarily opened also in this manner.

The heelholder will open automatically also when the skiing boot has been released by the toe iron, which is not shown. In that case the carriage 2 with the soleholder 12 moves to the left in FIG. 1. Before the rear end wall 4 of the carriage engages the collar 5 of the adjusting screw 6, the web 27 of the second locking lever 25 engages the free end of the leg 9 of the member 8 so that the first locking lever 15 is turned about the pivot pin 14 and the lever 21 is thus unlocked. The opening spring 13 then moves the soleholder 12 to its open position in which it is ready to receive the skiing boot.

The heelholder shown in FIG. 2 differs only slightly from the heelholder of FIG. 1. Like parts are designated with the same reference characters in both figures. The embodiment of FIG. 2 differs from the embodiment of FIG. 1 in that a second locking lever 40 is provided, which cannot be actuated to open the heelholder by a direct application of pressure to the second locking lever 40. To prevent an unintended actuation of the toggle joint, the rear end wall 41 of the soleholder 42 has a sufficiently large height. Cap 38 which functions as a pedal in the embodiment of FIG. 1 is not shown in FIG. 2. However, tensile element 43 is provided. Tensile element 43 is connected to the locking pin 24 of the second locking lever 40 and extends upwardly out of the soleholder 42. That tensile element can be actuated to pull the locking pin 24 directly out of engagement with the depression 23 of the lever 21.

Alternatively, a heelholder may be provided with means for actuating the second locking lever by the direct application of pressure or tension thereto. The indirect toggle joint provided according to the invention for an indirect actuation of the lockiing lever permits an opening of the heelholder by an extremely small force, which will be a great advantage particularly if the skiier is in an emergency.

What is claimed is:

1. A heelholder for a safety ski binding, said heelholder comprising:

wall means;

a soleholder pivotally mounted on said wall means for movement between open and closed positions, said soleholder being biassed towards the open position and movable to the closed position upon insertion of the heel of a boot into the binding;

lever means mounted on said soleholder and movable between an obstructed position for releasably holding said soleholder in the closed position and an unobstructed position for enabling voluntary movement of said soleholder to the open position;

first locking means mounted on said wall means in the path of said lever means and movable between a locking position for releasably blocking said soleholder in the closed position and a releasing position for releasing said soleholder to the open position in response to predetermined forces applied to said soleholder and transmitted by said lever means to said first locking means;

release controlling spring means for biassing said first locking means towards said locking position;

second locking means pivotally mounted on said wall means and movable between a blocking position for blocking said lever means against movement from said obstructed position and an unblocking position for enabling movement of said lever means to the unobstructed position, said second locking means being biassed towards said blocking position; and voluntary release means for moving said second locking means from said blocking position to said unblocking position, said voluntary release means including a first toggle member pivotally mounted on said soleholder between inactive and active positions and a second toggle member pivotally mounted on said first toggle member for actuating said second locking means, said second toggle member moving said second locking means to the unblocking position in response to movement of said first toggle member to said active position, to enable the movement of said soleholder to the open position without overcoming the force of said release controlling spring.

2. A heelholder according to claim 1 wherein said second toggle member is connected to said first toggle member by a hinge, and wherein said first toggle member has a portion which extends beyond the hinge and is formed with a depression.

3. A heelholder according to claim 1 wherein said soleholder includes a shoe receiving part and said toggle members are connected by a hinge, and said shoe-receiving part of the soleholder and said hinge are disposed on opposite sides of the pivotal axis of the soleholder.

4. A heelholder according to claim 1 wherein said second locking means extends rearwardly of said toggle members and is angled upwardly to extend above said toggle members.

5. A heelholder according to claim 4 wherein said second locking means includes a rearward free end portion defining a depressible pedal.

6. A heelholder according to claim 1 and further comprising a tension member connected to the second locking means and extending through said soleholder to a position accessible by a skier for voluntarily moving said second locking means to the unblocking position.

* * * * *